US009523547B1

(12) United States Patent
Compton

(10) Patent No.: US 9,523,547 B1
(45) Date of Patent: Dec. 20, 2016

(54) BORE HEALING MECHANISM

(71) Applicant: Logan M. Compton, Fredericksburg, VA (US)

(72) Inventor: Logan M. Compton, Fredericksburg, VA (US)

(73) Assignee: The United States Of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/794,556

(22) Filed: Jul. 8, 2015

(51) Int. Cl.

| | |
|---|---|
| ***B05B 13/06*** | (2006.01) |
| ***B05C 11/10*** | (2006.01) |
| ***F41A 21/22*** | (2006.01) |
| ***C23C 24/04*** | (2006.01) |
| ***B05C 19/00*** | (2006.01) |

(52) U.S. Cl.
CPC ..... *F41A 21/22* (2013.01); *B05B 13/0618* (2013.01); *B05B 13/0627* (2013.01); *B05C 11/1021* (2013.01); *B05C 19/00* (2013.01); *C23C 24/04* (2013.01)

(58) Field of Classification Search
CPC ..... B05B 13/0627; B05B 7/1486; B05B 15/0412; B05C 11/1005
USPC ..... 118/308, 306, 317, 622, 712; 427/236
See application file for complete search history.

(56) References Cited

U.S. PATENT DOCUMENTS

| | | | | |
|---|---|---|---|---|
| 5,136,974 | A * | 8/1992 | Lisec | E06B 3/67343 118/323 |
| 5,620,520 | A * | 4/1997 | Duffy | B05B 13/0609 118/308 |
| 6,124,563 | A * | 9/2000 | Witherspoon | C23C 4/12 219/121.47 |
| 8,192,799 | B2 | 6/2012 | Kay et al. | 427/427 |
| 8,697,184 | B2 | 4/2014 | Hertter et al. | 427/190 |
| 2003/0165689 | A1* | 9/2003 | Miller | B05B 7/205 428/419 |
| 2007/0215677 | A1 | 9/2007 | Floyd et al. | 228/122.1 |
| 2008/0107890 | A1 | 5/2008 | Bureau et al. | 428/323 |
| 2010/0221425 | A1* | 9/2010 | Liu | C23C 14/022 427/249.7 |
| 2012/0171374 | A1* | 7/2012 | Calla | B05B 13/0627 427/236 |

(Continued)

OTHER PUBLICATIONS

L. Hester et al.: Evaluating Material Performance Between High Current Contact, *IEEE Transactions on Plasma Science* 43(5), 1572-1579, May 2015; Electromagnetic Launch Technology 2014, 17$^{th}$ Symposium.

(Continued)

*Primary Examiner* — Yewebdar Tadesse
(74) *Attorney, Agent, or Firm* — Gerhard W. Thielman, Esq.

(57) ABSTRACT

A device is provided for repairing erosion damage to a bore of a railgun with metal powder. The bore has a surface contour that extends longitudinally of the railgun. The device includes a housing, a profilometer sensor and a nozzle. The housing has a configuration that conforms to the surface contour and an upstream face on a longitudinal end. The profilometer sensor mounts to the upstream face to measure depth of the erosion and indicate a divot in the bore that involves repair to match the surface contour. The nozzle mounts to the upstream face to spray the metal powder from a reservoir within the housing in response to the divot indicated by the profilometer.

4 Claims, 3 Drawing Sheets

(56) References Cited

U.S. PATENT DOCUMENTS

2013/0084421 A1 4/2013 Hertter et al. ..... 428/76

OTHER PUBLICATIONS

M. Dufour et al.: "Inspection of hard-to-reach industrial parts using small-diameter probes" *SPIE Newsroom*, 10.1117/2.1200610.0467.

* cited by examiner

BORE HEALING MECHANISM

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to repair mechanisms for railgun bores.

When a gun-type weapon is discharged, the projectile bullet travels through the weapon's bore at a high relative velocity. The bullet to bore interaction produces a finite amount of wear on the bore. After some number of wear cycles, the bore dilates to a critical point and can no longer be deemed safe to operate. In railgun firings, the interaction between the armature and bore is much more complicated than that of a conventional chemical based weapon due to the high level of electrical energy that can cause erosion damage in specific locations within the bore.

SUMMARY

Due to the high erosion in railgun designs from electrical energy exposure, there is need for a process for repairing the bore to avoid the cost of completely replacing the worn bore. Conventional maintenance techniques yield disadvantages addressed by various exemplary embodiments of the present invention. In particular, exemplary embodiments provide a device for repairing erosion damage to a bore of a railgun with metal powder.

The bore has a surface contour that extends longitudinally of the railgun. The device includes a housing, a profilometer sensor and a nozzle. The housing has a configuration that conforms to the surface contour and an upstream face on a longitudinal end. The profilometer sensor mounts to the upstream face to measure depth of the erosion and indicate a divot in the bore that involves repair to match the surface contour. The nozzle mounts to the upstream face to spray the metal powder from a reservoir within the housing in response to the divot indicated by the profilometer.

This and other objects are realized by the present invention, one embodiment of which relates to a method for the repair and healing of worn weapons bores. This includes subjecting the bores to cold spraying to deposit bore material at the worn locations therein. Additional aspects and/or advantages of the invention will be set forth in part in the description which follows and, in part, will be obvious from the description, or may be learned by practice of the invention.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Exemplary embodiments are predicated on the discovery that worn bores can be restored to substantially their original condition utilizing dynamic cold spraying technology. These embodiments enable the addition of bore material to the locations within the bore that have been damaged from erosion by repeated firings, thereby greatly extending the service life thereof.

Dynamic cold spraying or cold spraying technology is a coating deposition method that accelerates metals, polymers, or composite material powders at supersonic speeds towards a substrate surface. The imposition of the powder particle upon the surface causes plastic deformation of the particles, resulting in the adherence thereof to the substrate surface. Moreover, the employment of gas dynamic cold spraying enables the utilization of powders of metals dissimilar from that of the bore, should the occasion arise to impart different material properties in discrete locations throughout the length of the bore. Metal powder can be ejected unheated onto the surface contour of the bore to fill in detected divots, thereby referred to as a "cold spraying" technique.

Figure 1:
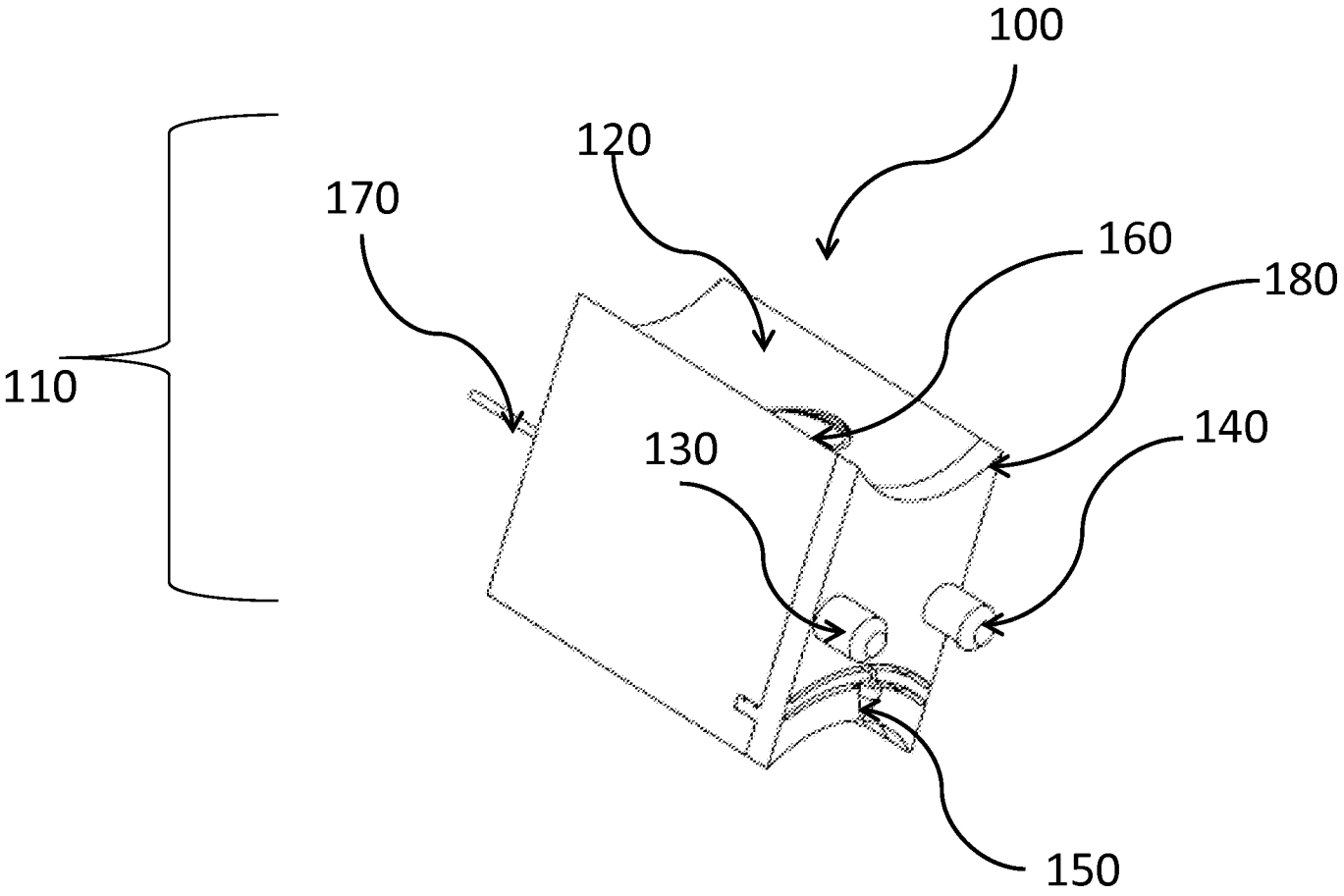
FIG. 1 is an isometric view of a bore healing system.

FIG. 1 shows an isometric view 100 of a cold spraying mechanism 110 for bore healing according to exemplary embodiments. The mechanism 110 includes a housing 120 shaped to conform to the bore's surface contours to ensure stabilization and accurate location sensing. Disposed within the bore, the mechanism 110 can travel with the upstream side forward, which corresponds to left and slightly downward in view 100. Starboard and port profilometer sensors 130 and 140 rotate and sweep the topography of the bore surface to measure the depth and location of damage or dilation relative to the design profile of the bore. A profilometer sensor constitutes a measuring instrument used for quantifying surface roughness by determining surface profile via distance, such as by a stylus probe.

The profilometer sensors 130 and 140 provide feedback as to the amount of deposition required to successfully repair any void, crack, or dilation of the core. A nozzle 150 dispenses powder onto the bore surface. The powder can consist of the same metal composition as the bore surface or of a stronger metal composition. The powder feeding into the nozzle 150 is stored in a hopper 160. The powder is accelerated by a high pressure line 170 that feeds into the mechanism 110. Particle velocity of the powder is maximized through the nozzle 150 to achieve optimal deposition as the mechanism 110 travels longitudinally along the bore.

Figure 2:
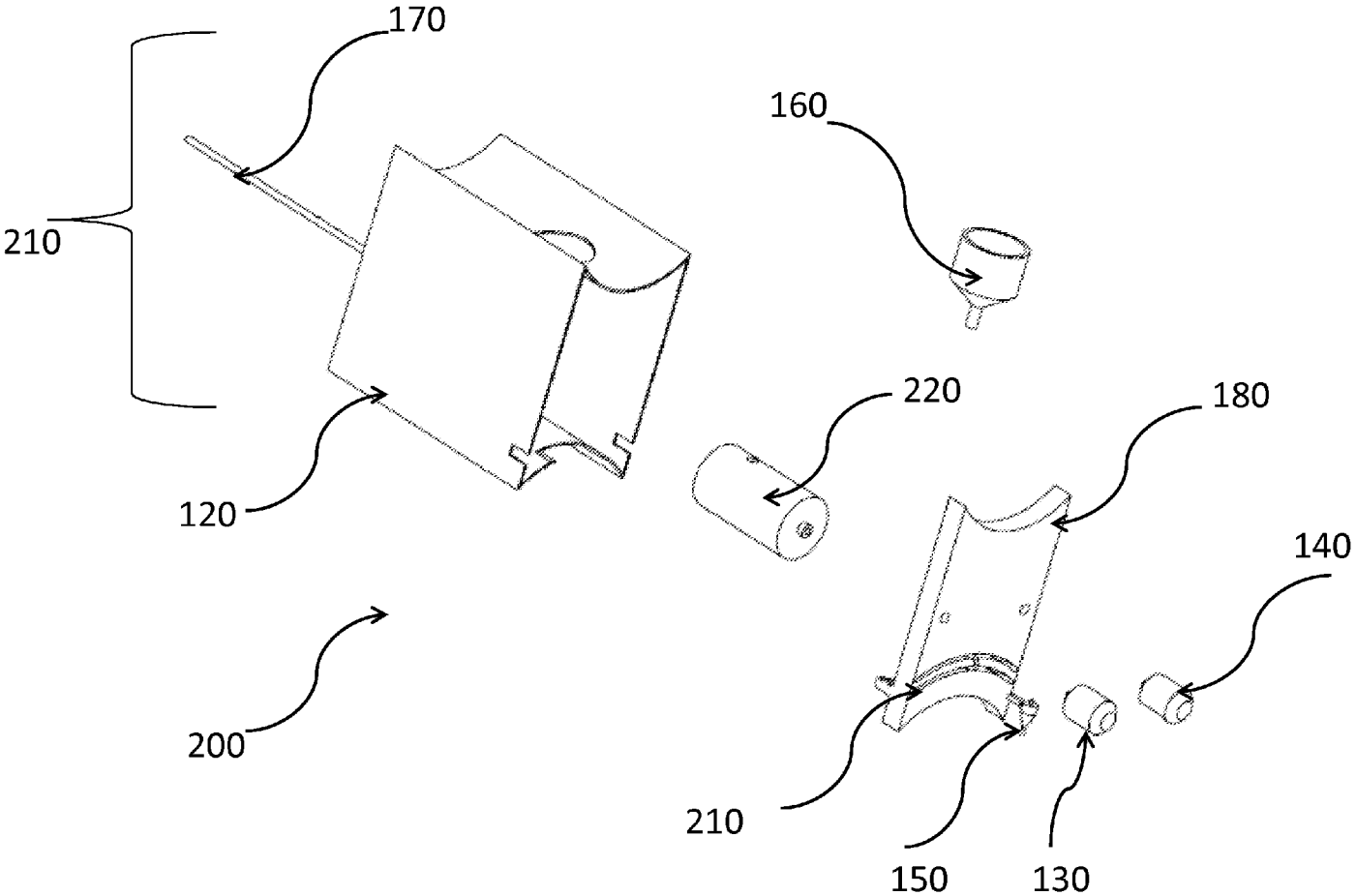
FIG. 2 is an isometric exploded view of the bore healing system.

FIG. 2 shows an isometric exploded view 200 of the spraying system 110 showing individual components. Nozzle tracks 210 are disposed on the front face of the housing 120 to conform to the bore's topography so as to follow the bore surface as the nozzle 150 travels laterally. Plumbing 220 leads from a powder source or hopper 160 to a heating source 220 that preheats the powder to optimize deposition inside the housing 120 to the nozzle 150 from which the heated powder is deposited onto the bore.

The tracks 210 on which the nozzle 150 and the pluming 220 follow the lateral contour of the bore. While traveling laterally, the nozzle 150 pivots to being normal to the tracks 210. This ensures that the direction of the particulate spray from the nozzle 150 is tangential to the geometry of the surface of the bore. The nozzle tracks 210 are designed to be offset a predetermined distance from the bore geometry surface and therefore offset the nozzle from the bore surface at a predetermined distance to optimize material deposition.

Figure 3:
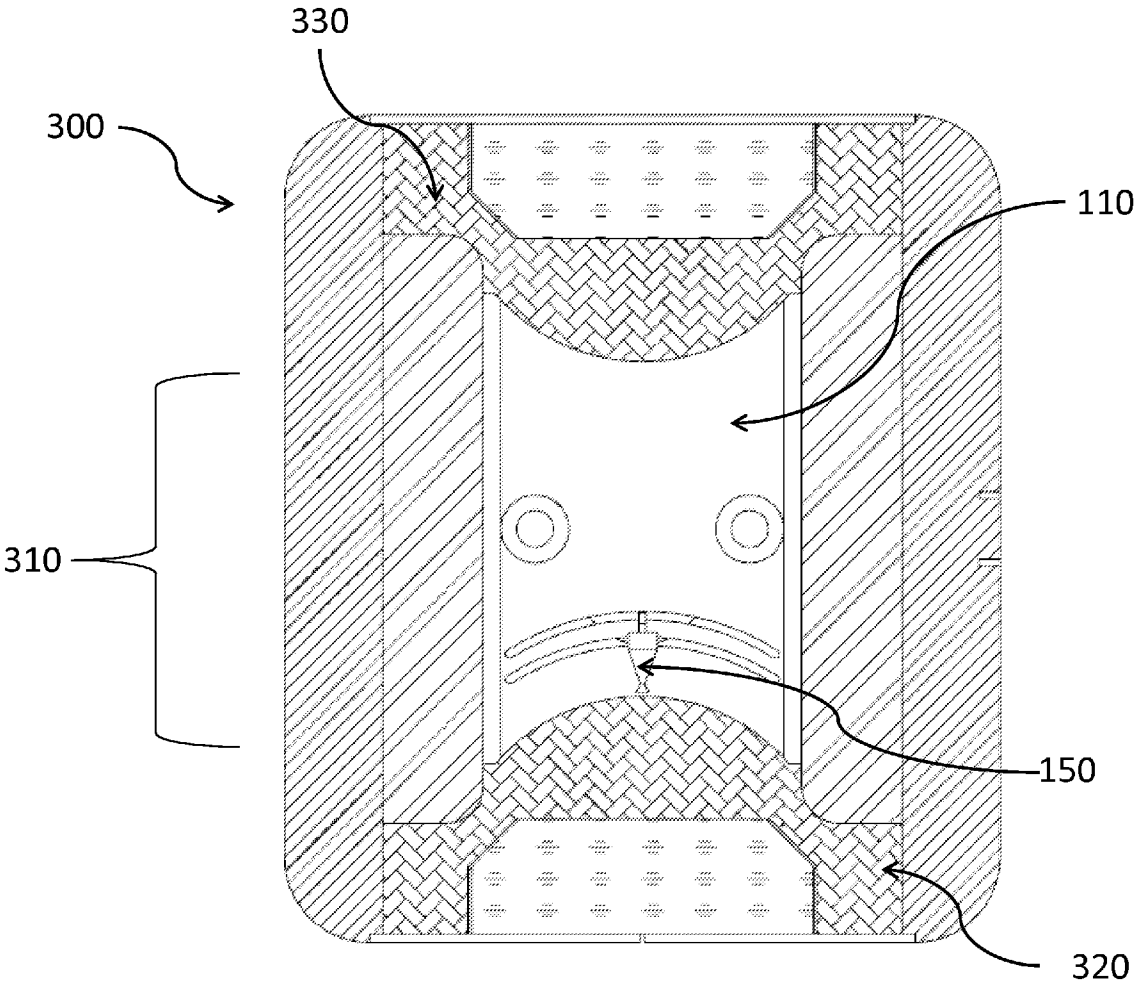
FIG. 3 is a cross-section view of a railgun core with the bore healing system.

FIG. 3 shows a cross-section elevation view 300 of a fully assembled railgun core 310 with the bore healing mechanism 110 disposed inside seated properly between a lower rail 320 and an upper rail 330, on which the armature travels after repair of the bore. As the mechanism 110 travels along the bore, the nozzle 150 deposits powder in response to perceived need based on the sensors 130 and 140.

Exemplary embodiments thus enable the repair and healing of damaged or heavily worn bores, thereby postponing or even eliminating the necessity of replacement thereof. This effect reduces costs of the operation of the weapon system throughout its lifetime. The bore repairing system of the invention enables the repair of bores in situ, as opposed to detachment the barrel or core and shipping to a remote location, thereby conserving time and money especially in mission critical scenarios.

Although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

what is claimed is:

1. A device for repairing erosion damage to a bore of a railgun with metal powder, said bore having a surface contour extending longitudinally of said railgun, said device comprising:

a housing having a configuration that conforms to the surface contour and an upstream face on a longitudinal end;

a profilometer sensor mounted to said upstream face to measure depth of the erosion and indicate a divot in the bore that involves repair to match the surface contour; and a nozzle mounted to said upstream face to spray the metal powder from a reservoir within said housing in response to said divot indicated by said profilometer sensor.

2. The device according to claim 1, wherein said nozzle shifts laterally along a track that traces the surface contour.

3. The device according to claim 2, wherein said nozzle pivots to be perpendicular to the surface contour while shifting laterally along said track.

4. The device according to claim 1, wherein said profilometer sensor includes port and starboard profilometer sensors.

* * * * *